United States Patent [19]

Barlics

[11] Patent Number: 4,606,470

[45] Date of Patent: Aug. 19, 1986

[54] SPIN FUSION METHOD AND CONTAINER MADE THEREFROM

[75] Inventor: John J. Barlics, North Edison, N.J.

[73] Assignee: Superpac Vending (Curacao) N.V., The Bahamas

[21] Appl. No.: 670,353

[22] Filed: Nov. 9, 1984

[51] Int. Cl.[4] ..... B65D 41/02

[52] U.S. Cl. ..... 215/232; 215/31; 156/69

[58] Field of Search ..... 215/31, 232; 156/69

[56] References Cited

U.S. PATENT DOCUMENTS 4,259,419 3/1981 Uba et al. ..... 156/69 X 4,337,104 6/1982 Lynn ..... 156/69

FOREIGN PATENT DOCUMENTS 16434 6/1978 Japan ..... 156/69

*Primary Examiner*—Donald F. Norton

*Attorney, Agent, or Firm*—Lerner, David, Littenberg, Krumholz & Mentlik

[57] ABSTRACT

A container has a neck adapted for spin fusion to a closure for the container. A trough positioned in the neck of the container collects fines generated during the spin fusion operation so as to avoid contaminating the contents of the container.

7 Claims, 2 Drawing Figures

SPIN FUSION METHOD AND CONTAINER MADE THEREFROM

FIELD OF THE INVENTION

The present invention relates to containers which are made by spin fusing a closure to the container, and, more particularly, to a technique by which fines generated during the spin fusion operation can be collected and trapped within the container without contaminating the contents of the container.

BACKGROUND OF THE INVENTION

There are many different techniques for attaching a closure to a container. One such technique involves providing the closure and the container with mating threads. Although threaded closures can be made tamperproof, containers employing such closures are susceptible to leakage as a result of the wearing of the threads.

Closures can also be ultrasonically welded or glued to a container. Although ultrasonic welding and gluing avoid the leakage problem associated with a threaded connection, such techniques cannot be used when the container and closure are made from such materials as polyethylene and polypropylene, which are popular materials for making plastic containers.

Spin fusion is another technique for attaching a closure to a container. In accordance with the spin fusion technique, the closure is rotated relative to the container, the friction and resulting heat generated by the relative rotation of the closure and container melting a portion of the closure and/or container which, upon solidification, fuses the closure and container together. One problem associated with such a spin fusion technique involves the production of fines (i.e., small pieces of container and/or closure material) as a result of the rubbing contact between the closure and container during the spin fusion operation. If these fines are not collected, they can contaminate the contents of the container.

SUMMARY OF THE PRESENT INVENTION

The present invention overcomes the problems and disadvantages described above by collecting the fines generated during the spin fusion of a closure to a neck of a container. In accordance with one aspect of the invention, the neck of the container is provided with an internal trough positioned so as to collect the fines generated during the spin fusion operation. Another aspect of the invention involves providing the closure with a dependent skirt which cooperates with the trough to seal the fines in the trough, thereby preventing contamination of the contents of the container by the fines. A still further aspect of the invention involves providing the closure with a beveled outer rim designed to function as a spin surface during the spin fusion operation.

BRIEF DESCRIPTION OF THE DRAWINGS

For a more complete understanding of the present invention, reference is made to the following detailed description considered in conjunction with the accompanying drawings, in which.

DETAILED DESCRIPTION OF THE EXEMPLARY EMBODIMENT

Figure 1:
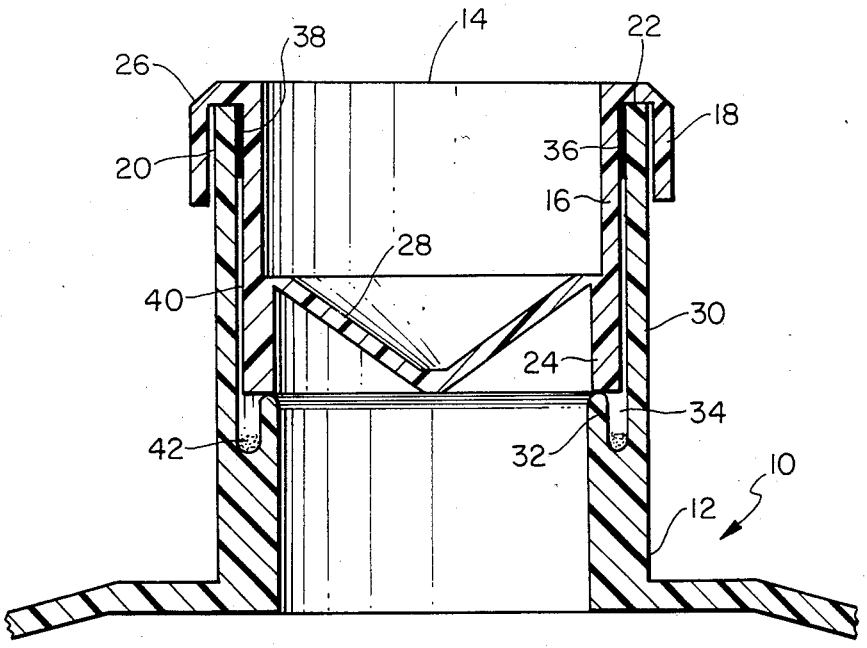
FIG. 1 is a cross-sectional view of an exemplary embodiment of a neck and closure arrangement for a container constructed in accordance with the present invention, the container being shown at the conclusion of a spin fusion operation.

Referring to FIG. 1, there is shown a container 10 which includes a neck 12 and a cap 14. The container 10, including the neck 12 and the cap 14, is made from a suitable plastic, such as polyethylene or polypropylene. Set forth below is a more detailed description of the container 10 followed by a description of how the container 10 is made.

Referring still to FIG. 1, the cap 14 is provided with a circular sidewall 16. An outer circular skirt 18 surrounds the sidewall 16 to form a downwardly opening annular groove 20 having a closed end 22. The cap 14 is also provided with an inner circular skirt 24, a beveled upper peripheral edge 26 and a removable central portion 28 for reasons to be explained hereinafter.

The neck 12 of the container 10 includes a long outer sidewall 30 and a short inner sidewall 32. The outer sidewall 30 cooperates with the inner sidewall 32 to form an annular trough 34. An upper portion 36 of the outer sidewall 30 is received in the annular groove 20 in the cap 14. A band 38 of plastic material formed by a spin fusion operation to be described hereinafter bridges an annular clearance space 40 between the sidewall 16 of the cap 14 and the outer sidewall 30 of the neck 12 of the container 10 to permanently attach the cap 14 to the neck 12 of the container 10. The inner sidewall 32 of the neck 12 is contacted by the inner skirt 24 of the cap 14 to effectively seal the trough 34, whereby fines 42 generated during the spin fusion operation are collected and trapped in the trough 34 to thereby prevent the contamination of the contents of the container 10 by the fines 42. By removing the central portion 28 of the cap 14, the contents of the container 10 can be dispensed without coming into contact with the fines 42 entrapped in the trough 34.

Figure 2:
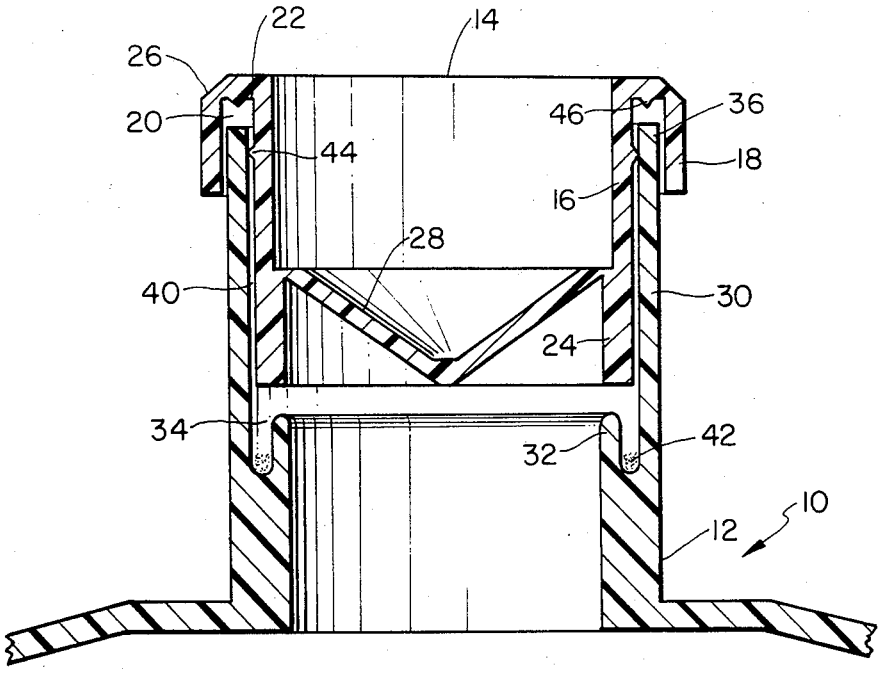
FIG. 2 is a cross-sectional view similar to the cross-sectional view of FIG. 1 except that the neck and closure arrangement is shown during the spin fusion operation.

With reference now to FIG. 2, the container 10 is shown prior to the permanent attachment of the cap 14 to the neck 12 of the container 10. More particularly, a circular bead 44 is provided on the sidewall 16 of the cap 14, the bead 44 being in contact with the upper portion 36 of the outer sidewall 30 of the neck 12 of the container 10. Another circular bead 46 is provided on the closed end 22 of the groove 20 in the cap 14, the bead 46 being out of contact with the upper portion 36 of the outer sidewall 30 of the neck 12 of the container 10.

In order to spin fuse the cap 14 to the neck 12 of the container 10, the cap 14 is spun relative to the neck 12 by any suitable conventional spin fusion apparatus, the beveled edge 26 of the cap 14 functioning as a spin surface which facilitates the release of the cap 14 from the spin fusion apparatus. The friction and resulting heat created by the bead 44 rubbing against the outer sidewall 30 of the neck 12 of the container 10 cause the bead 44 and a portion of the outer sidewall 30 to become molten. As the cap 14 is being spun relative to the neck 12 of the container 10, the cap 14 is also moved continuously in an axial direction relative to the neck 12 of the container 10, whereby the bead 46 comes into contact with the outer sidewall 30 of the neck 12 of the container 10. The friction and resulting heat created by the bead 46 rubbing against the outer sidewall 30 of the neck 12 of the container 10 cause the bead 46 and a portion of the outer sidewall 30 to become molten. During most of the spin fusion operation, the inner skirt 24 of the cap 14 does not contact the inner sidewall 32 of the neck 12 of the container 10, thereby preventing the inner skirt 24 and the inner sidewall 32 from generating fines as a result of their rubbing contact during the spin fusion operation. The fines 42 are, however, generated during the spin fusion operation as a result of the rubbing contact between the beads 44, 46 and the outer sidewall 30 of the neck 12 of the container 10. The fines 42, which travel along the clearance space 40 between the cap 14 and the neck 12 of the container 10, are collected in the trough 34, which is positioned directly below the clearance space 40. Near the end of the spin fushion operation, when the material forming the band 38 is still molten, the inner skirt 24 of the cap 14 contacts the inner sidewall 32 of the neck 12 of the container 10 (see FIG. 1), thereby effectively sealing the trough 34. When the molten material which forms the band 38 finally solidifies at the end of the spin fusion operation, the cap 14 is permanently attached to the neck 12 of the container 10 so as to permanently entrap the fines 42 in the trough 34, thereby preventing the fines 42 from contaminating the contents of the container 10. Inasmuch as the seal created by the inner skirt 24 of the cap 14 and the inner sidewall 32 of the neck 12 of the container 10 is substantially liquid tight, contamination is prevented even if the container 10 holds a liquid.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

I claim:

1. A container having a neck adapted for spin fusion to a closure for the container, comprising collecting means within the container for collecting fines generated during the spin fusion of the neck to the closure, the collecting means including a trough positioned within the neck of the container; sealing means for sealing fines in the trough, the sealing means including a skirt on the closure for the container, the skirt extending into the neck of the container and being engageable with the trough so as to seal fines therein; and a rim on the closure, the rim being beveled so as to function as a spin surface.

2. A method of preventing the contamination of the contents of a container by fines generated during the spin fusion of a neck of the container to a closure for the container, comprising the step of collecting the fines within the container as they are generated during the spin fusion of the neck to the closure.

3. A method according to claim 2, wherein the fines are collected in a trough positioned within the neck of the container.

4. A method according to claim 3, further comprising the step of sealing the fines in the trough.

5. A method according to claim 4, wherein the fines are sealed in the trough by a skirt on the closure for the container.

6. A method according to claim 5, further comprising the step of maintaining the closure in a first position, in which the skirt of the closure is kept out of engagement with the trough, during the spin fusion of the closure to the neck of the container and moving the closure to a second position, in which the skirt is in engagement with the trough, at or near the end of the spin fusion operation.

7. A method according to claim 6, wherein the container is spun on a beveled rim of the closure during the spin fusion of the closure to the neck of the container.

* * * * *